US010293336B2

(12) United States Patent
Beebe et al.

(10) Patent No.: US 10,293,336 B2
(45) Date of Patent: May 21, 2019

(54) NON-DISPLASIVE PIPETTE

(71) Applicant: Wisconsin Alumni Research Foundation, Madison, WI (US)

(72) Inventors: David J. Beebe, Monona, WI (US); David J. Guckenberger, Jr., Oconomowoc, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 157 days.

(21) Appl. No.: 15/176,924

(22) Filed: Jun. 8, 2016

(65) Prior Publication Data

US 2017/0354964 A1 Dec. 14, 2017

(51) Int. Cl.
*B01L 3/02* (2006.01)

(52) U.S. Cl.
CPC ..... *B01L 3/0217* (2013.01); *B01L 3/0275* (2013.01); *B01L 2200/0684* (2013.01); *B01L 2200/0689* (2013.01); *B01L 2200/16* (2013.01); *B01L 2300/0832* (2013.01)

(58) Field of Classification Search
CPC ..... B01L 3/02; B01L 3/021
See application file for complete search history.

(56) References Cited

U.S. PATENT DOCUMENTS 5,104,625 A * 4/1992 Kenney ..... B01L 3/0279 422/520
6,482,362 B1 11/2002 Smith
2003/0223910 A1 12/2003 Jackson, III et al.
2006/0039833 A1* 2/2006 Yong ..... A61B 10/0045 422/400

FOREIGN PATENT DOCUMENTS

WO 2015116989 8/2015

* cited by examiner

*Primary Examiner* — Kathryn Wright
(74) *Attorney, Agent, or Firm* — Boyle Fredrickson, S.C.

(57) ABSTRACT

A non-displasive pipette is provided. The non-displasive pipette is configured for connection to a tip having a fluid therein. The tip includes an orifice to allow for the discharge of the fluid therefrom. The non-displasive pipette includes a body defining a chamber therethrough and having first and second opposite ends. The second end of the body is configured for connection to the tip. A plunger is slidably received in the chamber at the first end of the body. The plunger is moveable in the chamber between an extended position and a discharge position wherein the fluid is urged from tip through the orifice. An air discharge arrangement is configured to allow air from the chamber to escape therefrom and to maintain the fluid in the tip in response to connection of the second end of the body to the tip.

12 Claims, 11 Drawing Sheets

100
114
90
98
88
112
60
84
50
51
62
76
54
70
96
72
58
64

100
114
96
98
90
70
88
112
76
54
51
62
72
58
84
50
64

90
70
100
114
98
112
88
76
54
51
62
72
58
84
64

100
102
106
107
110
105
108
112
88
78
84
56
90
114
98
108
101
96
70
104
103
71
72
58
60
50
51
62
64

NON-DISPLASIVE PIPETTE

REFERENCE TO GOVERNMENT GRANT

This invention was made with government support under CA181648 awarded by the National Institutes of Health. The government has certain rights in the invention.

FIELD OF THE INVENTION

This invention relates generally to the prepackaging of reagents, analytes and the like on micro and nano liter scales, and in particular, to a non-displasive pipette connectable to a conventional pipette tip without displacing reagents, analytes and the like prepackaged therein from the tip.

BACKGROUND AND SUMMARY OF THE INVENTION

Prepackaging of reagents into kits has created a paradigm shift in biological assays. More specifically, the prepackaging of reagents has made it easier to sell reagents and easier for the end-user to perform an assay. In view of the foregoing, there has developed an ever increasing precedence towards prepackaging and utilizing reagents at even lower volumes, e.g., on the micro and nano liter scales. This creates an incentive and a challenge in the adoption of microfluidic technologies. The capability of prepackaging fluids in ways that are directly compatible with already existing automation techniques would significantly lower operational cost and accelerate assay times, thereby further reducing costs. By way of example, polymerase chain reaction (PCR) assays require on instrument reagent preparation followed by the dispensing of hundreds of small (few microliter) volumes.

One simple way to prepackage reagents would be to provide the reagents directly in a pipette tip. It can be appreciated that a process of prepackaging reagents in a pipette tip is fundamentally simple. Further, such a process does not require any modification to already existing pipette tips. However, pipette tips with prepackaged therein are not directly compatible with commercially available pipettes and pipetting instruments. As is known, current pipettes are comprised of a sealed chamber and a plunger. The plunger displaces air to aspirate and dispense fluids, and as such, forms an air-tight seal in the chamber. Disposable tips are installed onto the pipette by pressing the pipette into the tip. During this installation, the pipette actually displaces air in the pipette tip, forcing the air through the orifice of the pipette tip. This air displacement does not cause any issues when the tip is empty. However, if a fluid were to be stored in the tip, this displacement will force fluid out of the tip. As such, there exists a need for a non-displasive pipette having a tip for allowing reagents, analytes and the like to be prepackaged therein.

Therefore, it is a primary object and feature of the present invention to provide a non-displasive pipette having a tip for allowing reagents, analytes and the like to be prepackaged therein.

It is a further object and feature of the present invention to provide a non-displasive pipette having a tip for allowing reagents, analytes and the like to be prepackaged therein that is simple to utilize and inexpensive to manufacture.

It is a still further object and feature of the present invention to provide a non-displasive pipette having a tip for allowing reagents, analytes and the like to be prepackaged therein that is compatible with existing automation techniques.

In accordance with the present invention, a non-displasive pipette configured for connection to a tip having prepackaged fluid therein is provided. The non-displasive pipette includes a body having a tubular wall with an inner surface defining a chamber extending through the body between first and second ends thereof and an outer surface. A plunger is slidably received in a first end of the chamber of the body. The plunger is moveable along the inner surface of the tubular wall between a first extended position and a second depressed position. An air escape passage extends through at least one of the tubular wall of the body and the plunger. The chamber communicates with an environment outside of the pipette through the air escape passage with the plunger in the extended position. Alternatively, communication between the chamber and the environment outside of the pipette through the air escape passage is prevented with the plunger in the extended position.

The tip is receivable on the second end of the body and the fluid prepackaged in the tip remains therein in response to movement of the plunger from the extended position to the depressed position. The tip includes an orifice and the plunger is movable to a third discharge position wherein the fluid prepackaged in the tip is urged from the tip. A seal may extend about the plunger and forming a sealing interface with the inner surface of the tubular wall. The plunger includes a first end, a second end receivable in the chamber of the body and an outer surface. In a first embodiment, the air escape passage extends between the first end of the plunger and the outer surface of the plunger at a first location and the seal extends about the outer surface of the plunger between the first location and the first end of the plunger. In an alternate embodiment, the air escape passage extends through the tubular wall between the inner and outer surfaces thereof.

An air seal may be positioned along the outer surface of the tubular wall. The air seal is movable between a first closed position wherein the air seal overlaps an intersection of the air escape passage and the outer surface of the tubular wall so as to prevent a flow of air through the air escape passage and a second open position wherein the air escape passage is allowed to communicate with the environment outside of the pipette. A biasing structure may urge the air seal towards the closed position. Alternatively, the air seal may include a collar extending about the outer surface of the tubular wall. Rotation of the collar moves the air seal between the first closed position and the second open position.

In accordance with a further aspect of the present invention, a non-displasive pipette is provided. The non-displasive pipette is configured for connection to a tip having a fluid prepackaged therein. The tip includes an orifice to allow for the discharge of the fluid therefrom. The non-displasive pipette includes a body defining a chamber therethrough and having first and second opposite ends. The second end of the body is configured for connection to the tip. A plunger is slidably received in the first end of the chamber of the body. The plunger is moveable in the chamber between a first extended position and a second depressed position. An air escape passage extends through at least one of body and the plunger. The air escape passage is configured to allow air from the chamber to escape therefrom in response to connection of the tip to the second end of the body.

It is contemplated for the chamber to communicate with an environment outside of the pipette through the air escape passage with the plunger in the extended position. The chamber is isolated from the environment outside of the pipette through the air escape passage with the plunger in the depressed position. The fluid prepackaged in the tip remains therein in response to movement of the plunger from the extended position to the depressed position. The plunger is movable between the second depressed position and a third discharge position. The fluid prepackaged in the tip is urged from the tip through the orifice in response to movement of the plunger from the depressed position to the discharge position.

A seal may extend about the plunger and form a sealing interface with the body. The plunger includes a first end, a second end receivable in the chamber of the body and an outer surface. The air escape passage may extend through the plunger and intersects the outer surface of the plunger at a first location. The seal extends about the outer surface of the plunger between the first location and the first end of the plunger. Alternatively, the air escape passage may extend through the body.

An air seal may be positioned along an outer surface of the body. The air seal is movable between a first closed position wherein the air seal overlaps an intersection of the air escape passage and the outer surface of the body and prevents a flow of air through the air escape passage and a second open position wherein the air escape passage is allowed to communicate with the environment outside of the pipette. A biasing structure may be provided for urging the air seal towards the closed position. Alternatively, the air seal may include a collar extending about the outer surface of the body. Rotation of the collar moves the air seal between the first closed position and the second open position.

In accordance with a still further aspect of the present invention, a non-displasive pipette is provided. The non-displasive pipette is configured for connection to a tip having a fluid therein. The tip includes an orifice to allow for the discharge of the fluid therefrom. The non-displasive pipette includes a body defining a chamber therethrough and having first and second opposite ends. The second end of the body is configured for connection to the tip. A plunger is slidably received in the chamber at the first end of the body. The plunger is moveable in the chamber between an extended position and a discharge position wherein the fluid is urged from tip through the orifice. An air discharge arrangement is configured to allow air from the chamber to escape therefrom and to maintain the fluid in the tip in response to connection of the second end of the body to the tip.

The plunger is movable to a depressed position at a location between the extended position and the discharge position. The fluid in the tip is maintained therein in response to movement of the plunger from the extended position to the depressed position. A seal may extend about the plunger and forming a sealing interface with the body. The plunger includes a first end, a second end receivable in the chamber of the body and an outer surface. The air discharge arrangement may include an air escape passage extending between the first end of the plunger and the outer surface of the plunger at a first location. The seal extends about the outer surface of the plunger between the first location and the first end of the plunger. Alternatively, the air discharge arrangement includes an air escape passage extending through the body. An air seal is positioned along an outer surface of the body. The air seal is movable between a first closed position wherein the air seal prevents air from the exiting the chamber and a second open position wherein the air seal allows to exit the chamber. A biasing structure may be provided for urging the air seal towards the closed position. Alternatively, the air seal may include a collar extending about an outer surface of the body. Rotation of the collar moves the air seal between the first closed position and the second open position.

BRIEF DESCRIPTION OF THE DRAWINGS

The drawings furnished herewith illustrate a preferred construction of the present invention in which the above aspects, advantages and features are clearly disclosed as well as others which will be readily understood from the following description of the illustrated embodiments.

In the drawings:

FIG. 3 is a schematic, cross-sectional view of the pipette of the present invention and the pipette tip in an assembled configuration with a plunger of the pipette in a first position;

DETAILED DESCRIPTION OF THE DRAWINGS

Figure 1:
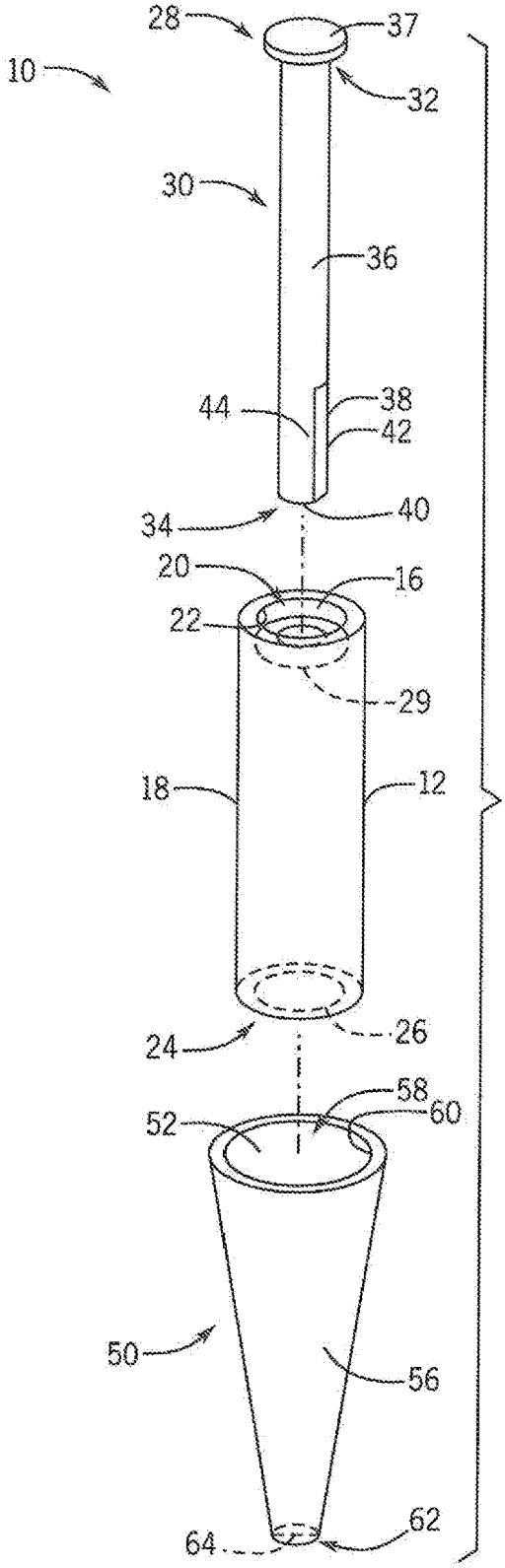
FIG. 1 is an exploded, isometric view of a pipette in accordance with the present invention and a pipette tip.

Referring to FIGS. 1-5, a non-displasive pipette in accordance with the present invention is generally designated by the reference numeral 10. Pipette 10 includes a generally hollow barrel 12 having an inner surface 14 defining passageway 16 therethrough and an outer surface 18. Barrel 12 further includes a first end 20 terminating at opening 22 and a second end 24 terminating at opening 26. In the depicted embodiment, first and second ends 20 and 24, respectively, are generally cylindrical and openings 22 and 26, respectively, therein, have generally equal dimensions. However, other configurations of barrel 12 and openings 22 and 26 are possible without deviating from the scope of the present invention. For example, barrel 12 may take the form of a conduit having a non-circular cross-section. It is contemplated for a generally circular seal, e.g. o-ring 29, having an outer surface 31 to be affixed to and forms an airtight seal with inner surface 14 of barrel 12 at a location adjacent first end 20 of barrel 12, for reasons hereinafter described. Inwardly directed portion 33 of outer surface 31 of o-ring 29 defines a passage 35 having a diameter.

Pipette 10 further includes plunger 28 partially received in passageway 16 through barrel 12. Plunger 28 includes an elongated stem 30 having first and second opposite ends 32 and 34, respectively, and a generally cylindrical outer surface 36. Elongated stem 30 has a diameter generally equal to the diameter of passage 35 though o-ring 29. Enlarged head 37, FIG. 1, may be affixed to or integral with first end 32 of elongated stem 30 to facilitate the insertion of second end 34 of elongated stem 30 into passageway 16 of barrel 12. Air passage 38 is provided in elongated stem 30 at a location adjacent second end 34 of elongated stem 30. More specifically, air passage 38 includes an inlet opening 40 communicating with second end 34 of elongated stem 30 and an outlet opening 42 communicating with outer surface 36 of elongated stem 30. While it is contemplated for air passage 38 to extend through the interior of elongated stem 30, in the depicted embodiment, air passage 38 is defined by recessed surface 44 formed in outer surface 36 of elongated stem 30.

It is intended for pipette 10 to be interconnected to a conventional pipette tip 50. Pipette tip 50 has a generally hollow, conical shape and includes inner surface 52 defining passageway 54 therethrough and outer surface 56. Pipette tip 50 further includes a first end 58 terminating at opening 60 and a second end 62 terminating at opening 64. In the depicted embodiment, opening 60 in first end 58 is substantially larger than opening 64 in second end 62. However, other configurations of pipette tip 50 are possible without deviating from the scope of the present invention. For example, pipette tip 50 may take the form of a tube or a conduit having a non-circular cross-section. Further, opening 60 in first end 58 of pipette tip 50 need not be substantially larger than opening 64 in second end 62. It is intended for passageway 54 through pipette tip 50 to be loaded with a selected fluid 51. Selected fluid 51 is retained in pipette tip 50 by the surface tension of selected fluid 51 at opening 64 in second end 62 of pipette tip 50.

Figures 2, 3, 4, 5:
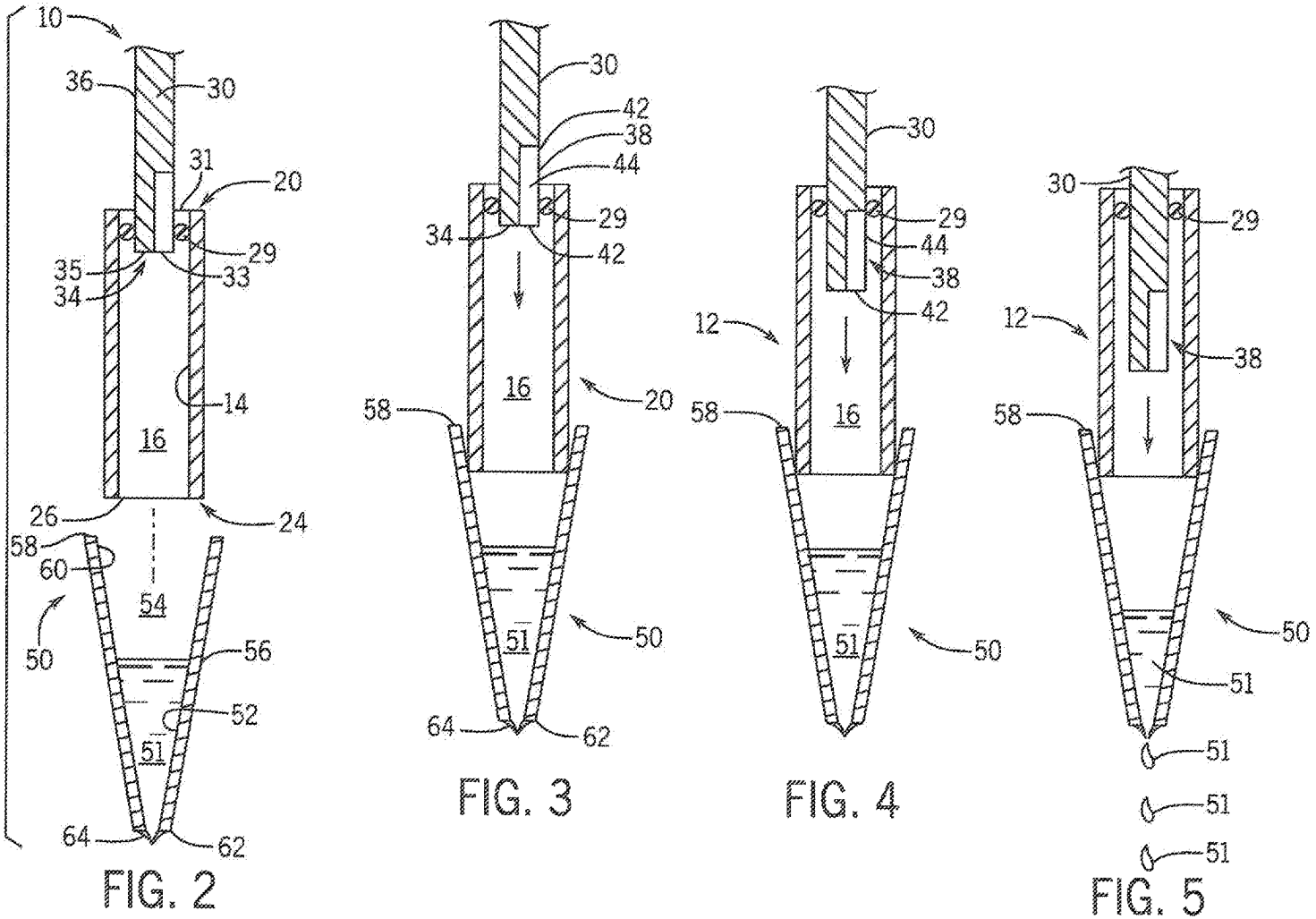
FIG. 2 is a schematic, cross-sectional view of the pipette of the present invention and the pipette tip in a disassembled configuration.
FIG. 3 is a schematic, cross-sectional view of the pipette of the present invention and the pipette tip in an assembled configuration.
FIG. 4 is a schematic, cross-sectional view of the pipette of the present invention and the pipette tip in an assembled configuration with the plunger of the pipette in a second position.
FIG. 5 is a schematic, cross-sectional view of the pipette of the present invention and the pipette tip in an assembled configuration with the plunger of the pipette in a third position.
Figure 6:
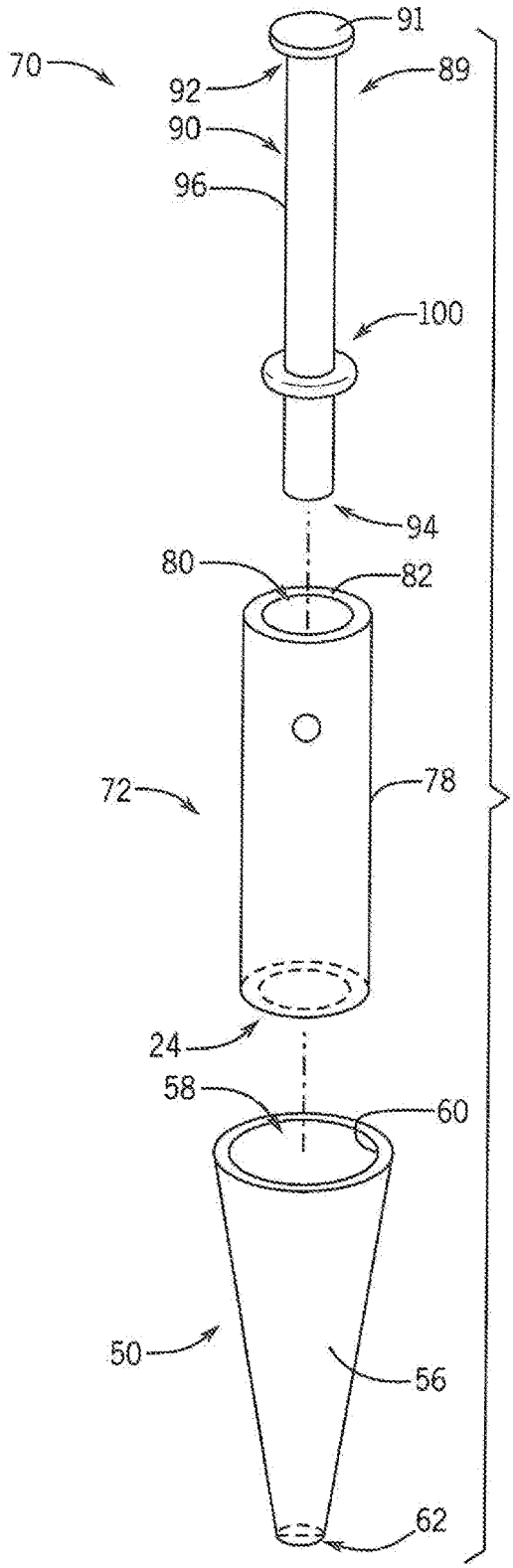
FIG. 6 is an exploded, isometric view of an alternate embodiment of a pipette in accordance with the present invention and the pipette tip.

In operation, elongated stem 30 of pipette 10 is inserted into opening 22 in first end 20 of barrel 12 to a first extended position wherein outer surface 36 of elongated stem 30 is positioned within passage 35 though o-ring 29 and engages inwardly directed portion 33 of o-ring 29, FIG. 2. In the first extended position, inlet opening 40 of air passage 38 through elongated stem 30 communicates with passageway 16 in barrel 12 and outlet opening 42 of air passage 38 through elongated stem 30 communicates with the environment outside of pipette 10.

With elongated stem 30 of pipette 10 in the first position, second end 24 of barrel 12 is inserted into opening 60 in first end 58 of pipette tip 50 such that outer surface 18 engages inner surface 52 of pipette tip 50, thereby frictionally retaining pipette tip 50 on pipette 10, FIG. 3. It can be appreciated that pipette 10 may be interconnected to pipette tip 10 in other manners without deviating from the scope of the present invention. In order to prevent air within passageway 16 from urging selected fluid 51 from opening 64 in second end 62 of pipette tip 50 as the pipette 10 is interconnected to pipette tip 50, the air pressure in passageway 16 is relieved as the air in passageway 16 is allowed to enter air passage 38 in elongated stem 30 through inlet opening 40 and pass therethrough into the environment outside of pipette 50 through outlet opening 42. Hence, air passage 38 in elongated stem 30 allows for pipette tip 50 to be installed on and connected to pipette 10 without causing selected fluid 51 to be ejected from pipette tip 50 by eliminating the potential increase in air pressure in passageway 16 (and passageway 54 in pipette tip 50) associated with the insertion of barrel 12 into pipette tip 50.

Once pipette 10 and pipette tip 50 are interconnected as heretofore described, the pipette 10 and pipette tip 50 combination may be transported to a desired location wherein selected fluid 51 may be urged from the pipette tip 50. More specifically, once pipette 10 and pipette tip 50 combination are transported to the desired location, elongated stem 30 of pipette 10 is axially inserted to a second position further into first end 20 of barrel 12 such that outlet opening 42 of air passage 38 communicates with passageway 16 in barrel 12, FIG. 4. With elongated stem 30 in the second position, outer surface 36 of elongated stem 30 forms an airtight seal with inwardly directed portion 33 of outer surface 31 of o-ring 29. As a result, outlet opening 42 of air passage 38, and hence passageway in barrel 12, is isolated from the environment outside of pipette 10.

With outlet opening 42 of air passage 38 isolated from the environment outside of pipette 10, the further axial insertion of elongated stem 30 of pipette 10 into first end 20 of barrel 12, for example to a third position, FIG. 5, results in the air captured in passageway 16 of barrel 12 urging the selected fluid 51 from pipette tip 50 through opening 64 in second end 62 of pipette tip 50. It can be appreciated that pipette 10 of the present invention allows for fluids to be prepackaged in pipette tips which are directly compatible with already existing automation techniques.

Referring to FIGS. 6-10, an alternate embodiment of a non-displasive pipette in accordance with the present invention is generally designated by the reference numeral 70. Pipette 70 includes a generally hollow barrel 72 having an inner surface 74 defining passageway 76 therethrough and an outer surface 78. Barrel 72 further includes a first end 80 terminating at opening 82 and a second end 84 terminating at opening 86. In the depicted embodiment, first and second ends 80 and 84, respectively, are generally cylindrical and openings 82 and 86, respectively, therein, have generally equal dimensions. However, other configurations of barrel 72 and openings 82 and 86 are possible without deviating from the scope of the present invention. For example, barrel 72 may take the form of a conduit having a non-circular cross-section. Further, it is contemplated for barrel 72 to include opening 88 extending between the inner and outer surfaces 74 and 78, respectively, at a location adjacent first end 80 of barrel 72, for reasons hereinafter described.

Pipette 70 further includes plunger 89 partially received in passageway 76 through barrel 72. Plunger 89 includes an elongated stem 90 having first and second opposite ends 92 and 94, respectively, and a generally cylindrical outer surface 96. Enlarged head 91 may be affixed to or be integral with first end 92 of elongated stem 90 to facilitate the insertion of second end 94 of elongated stem 90 into passageway 76 of barrel 72. It is contemplated for a generally circular seal, e.g. o-ring 98, to have an inwardly directed portion 101 of outer surface 104 of o-ring 98 affixed to and forming an airtight seal with outer surface 96 of elongated stem 90 of plunger 89 at a location adjacent first end 80 of barrel 72, for reasons hereinafter described. Outwardly directed portion 103 of outer surface 104 of o-ring 98 is engageable with inner surface 74 of barrel 72 and has a diameter.

Figures 7, 8, 9, 10:
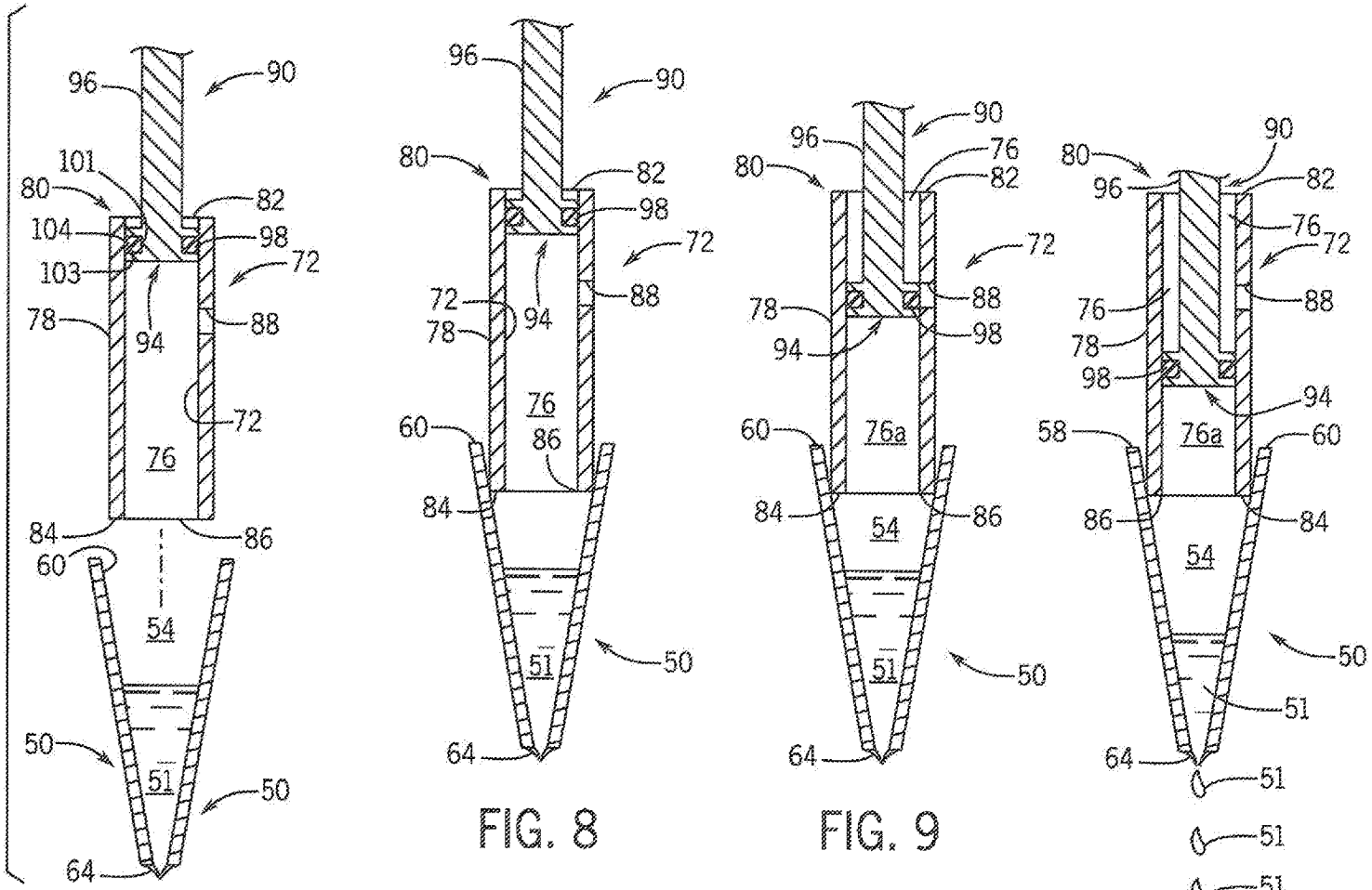
FIG. 7 is a schematic, cross-sectional view of the pipette of FIG. 6 and the pipette tip in a disassembled configuration.
FIG. 8 is a schematic, cross-sectional view of the pipette of FIG. 6 and the pipette tip in an assembled configuration with a plunger of the pipette in a first position.
FIG. 9 is a schematic, cross-sectional view of the pipette of FIG. 6 and the pipette tip in an assembled configuration with the plunger of the pipette in a second position.
FIG. 10 is a schematic, cross-sectional view of the pipette of FIG. 6 and the pipette tip in an assembled configuration with the plunger of the pipette in a third position.

In operation, elongated stem 90 of pipette 70 is inserted into opening 82 in first end 80 of barrel 72 to a first extended position wherein second end 94 of elongated stem 90 is received within passageway 76 of barrel 72 and outwardly directed portion 103 of outer surface 104 of o-ring 98 engages inner surface 74 of barrel 72 to form an airtight seal therewith, FIG. 7. In the first extended position, passageway 76 in barrel 72 communicates with the environment outside of pipette 70 through opening 88 in barrel 72.

With elongated stem 90 of pipette 70 in the first position, second end 84 of barrel 72 is inserted into opening 60 in first end 58 of pipette tip 50 such that outer surface 78 of barrel 72 engages inner surface 52 of pipette tip 50, thereby frictionally retaining pipette tip 50 on pipette 70, FIG. 8. It can be appreciated that pipette 70 may be interconnected to pipette tip 50 in other manners without deviating from the scope of the present invention. In order to prevent the air pressure within passageway 76 from urging selected fluid 51 from opening 64 in second end 62 of pipette tip 50 as the pipette 70 is interconnected to pipette tip 50, air in passageway 76 is allowed to exit passageway 76 through opening 88 in barrel 72 and pass into the environment outside of pipette 70. Hence, opening 88 in barrel 72 allows for pipette tip 50 to be installed on and connected to pipette 70 without causing selected fluid 51 to be ejected from pipette tip 50.

Once pipette 70 and pipette tip 50 are interconnected as heretofore described, the pipette 70 and pipette tip 50 combination may be transported to a desired location wherein selected fluid 51 may be urged from the pipette tip 50. More specifically, elongated stem 90 of pipette 70 may be axially inserted to a second position further into first end 80 of barrel 72 such that portion **76*a* of passageway 76 in barrel 72, in communication with passageway 54 through pipette tip 50, is isolated from the environment outside of pipette 70, FIG. 9. With portion 76*a* of passageway 76 in barrel 72 being isolated from the environment outside of pipette 70, the further axial insertion of elongated stem 90 of pipette 70 into first end 80 of barrel 72, for example to a third position, FIG. 10, results in the air captured in portion 76*a* of passageway 76 of barrel 72 urging selected fluid 51 from pipette tip 50 through opening 64 in second end 62 of pipette tip 50**.

Referring to FIGS. 11-14, it can be appreciated that pipette 70 may be modified such that o-ring 98 is detached from elongated stem 90 of pipette 70 and such that outwardly directed portion 103 of outer surface 104 of o-ring 98 is affixed to inner surface 74 of barrel 72 to form an airtight seal therewith. With o-ring 98 detached from elongated stem 90, it is contemplated for outer surface 96 of elongated stem 90 of plunger 89 to form a slideable interface with inwardly directed portion 101 of outer surface 104 of o-ring 98 forming an airtight seal therewith. In such an arrangement, it is contemplated to provide a sealing mechanism 100 for allowing a user to selectively seal opening 88 in barrel 72. Sealing mechanism 100 includes a lever 102 having opposite first and second ends 108 and 110, respectively, and a pair of eyelets, generally designated by the reference numeral 107, projecting from a first side 105 thereof. Eyelets 107 are pivotably connected to support 106 projecting radially from outer surface 78 of barrel 72 of pipette 70 by pivot pin 108 so as to allow lever 102 to pivot between a first sealing position, FIGS. 11 and 13-14, wherein first end 108 of lever 102 is adjacent opening 88 in barrel 72 and a second open position, FIG. 12, wherein first end 108 of lever 102 is spaced from opening 88 in barrel 72. First end 108 includes an o-ring 112 mount thereto and having an outer diameter greater than the diameter of opening 88 in barrel 72. It is intended for o-ring 112 to engage outer surface 78 of barrel 72 of pipette 70 and to surround opening 88 through barrel 72 so as to isolate passageway 76 through barrel 72 from the environment outside of pipette 70. Spring 114 extends between outer surface 78 of barrel 72 and second end 110 of lever 102 and biases lever 102 towards the sealing position.

Figures 11, 12, 13, 14:
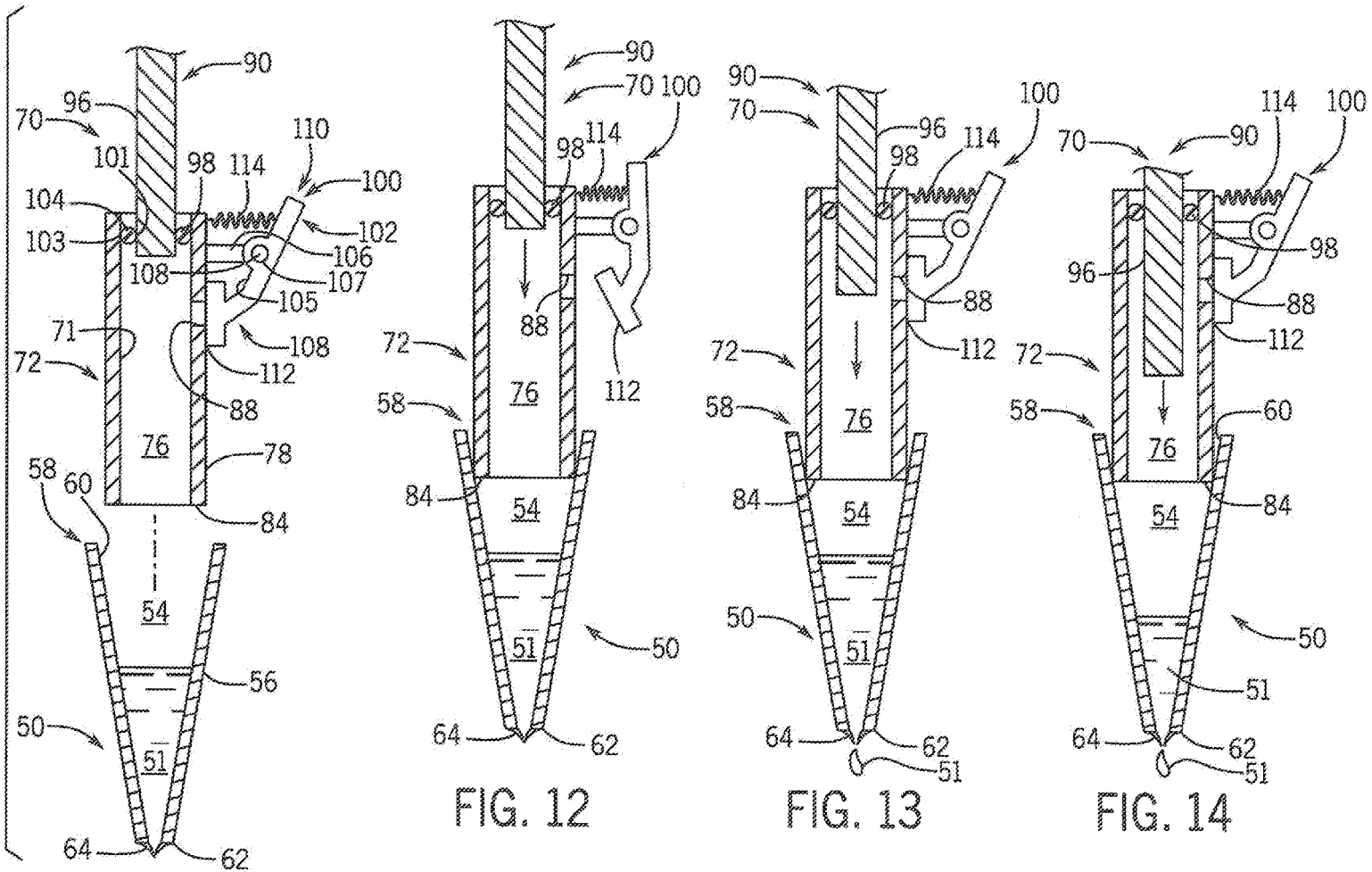
FIG. 11 is a schematic, cross-sectional view of the pipette of FIG. 6 including a first embodiment of a sealing arrangement and the pipette tip in a disassembled configuration.
FIG. 12 is a schematic, cross-sectional view of the pipette of FIG. 6 including the first embodiment of a sealing arrangement and the pipette tip in an assembled configuration with a plunger of the pipette in a first position.
FIG. 13 is a schematic, cross-sectional view of the pipette of FIG. 6 including the first embodiment of a sealing arrangement and the pipette tip in an assembled configuration with the plunger of the pipette in a second position.
FIG. 14 is a schematic, cross-sectional view of the pipette of FIG. 6 including the first embodiment of a sealing arrangement and the pipette tip in an assembled configuration with the plunger of the pipette in a third position.

In operation, with elongated stem 90 of pipette 70 in the first position and prior to connecting pipette 70 to pipette tip 50, a user may selectively depress second end 110 of lever 102 so as to pivot lever 102 from the sealing position, FIG. 11, to the open position, FIG. 12, wherein passageway 76 through barrel 72 communicates with the environment outside of pipette 70 through opening 88 in barrel 72. Thereafter, second end 84 of barrel 72 is inserted into opening 60 in first end 58 of pipette tip 50 such that outer surface 78 of barrel 72 engages inner surface 52 of pipette tip 50, thereby frictionally retaining pipette tip 50 on pipette 70, FIG. 12. It can be appreciated that pipette 70 may be interconnected to pipette tip 50 in other manners without deviating from the scope of the present invention. With lever 102 in the open position, air in passageway 76 is allowed to exit passageway 76 through opening 88 in barrel 72 and pass into the environment outside of pipette 70 as pipette tip 50 as pipette 70 is interconnected to pipette tip 50. As such, opening 88 in barrel 72 allows for pipette tip 50 to be installed on and connected to pipette 70 without causing selected fluid 51 to be ejected from pipette tip 50. Once pipette 70 is interconnected to pipette tip 50, second end 110 of lever 102 is released by the user such that lever 102 pivots from the open position, FIG. 12, to the sealing position, FIG. 13, so as to isolate passageway 76 through barrel 72 from the environment outside of pipette 70, thereby maintaining the environment of passageway 76 through barrel 72 within the pipette 70 and pipette tip 50 combination. In order to urge selected fluid 51 from the pipette tip 50, elongated stem 90 of pipette 70 is axially inserted into first end 80 of barrel 72 such that the air captured in portion 76*a* of passageway 76 of barrel 72 urge the selected fluid 51 from pipette tip 50 through opening 64 in second end 62 of pipette tip 50, FIGS. 13-14.

Referring to FIGS. 15-20, an alternate sealing arrangement for allowing a user to selectively seal opening 88 in barrel 72 of pipette 70 is generally designated by the reference numeral 120. Sealing mechanism 120 includes collar 122 having inner and outer surfaces 124 and 126, respectively, and an aperture 128 extending therethrough. Collar 122 is positioned about outer surface 78 of barrel 72 such that aperture 128 through collar 122 lies in a common plane with opening 88 through barrel 72 of pipette 70. Inner surface 124 of collar 122 slidably engages outer surface 78 of barrel 72 so as to allow collar 122 to rotate about outer surface 78 of barrel 72 of pipette 70 between a first sealing position, FIG. 19, wherein collar 122 overlaps opening 88 in barrel 72 and a second open position, FIG. 20, wherein aperture 128 though collar 122 is axially aligned with opening 88 in barrel 72. With collar 122 in the sealing position, passageway 76 through barrel 72 is isolated from the environment outside of pipette 70. With collar 122 in the open position, passageway 76 through barrel 72 communicates with the environment outside of pipette 70.

Figures 15, 16, 17, 18:
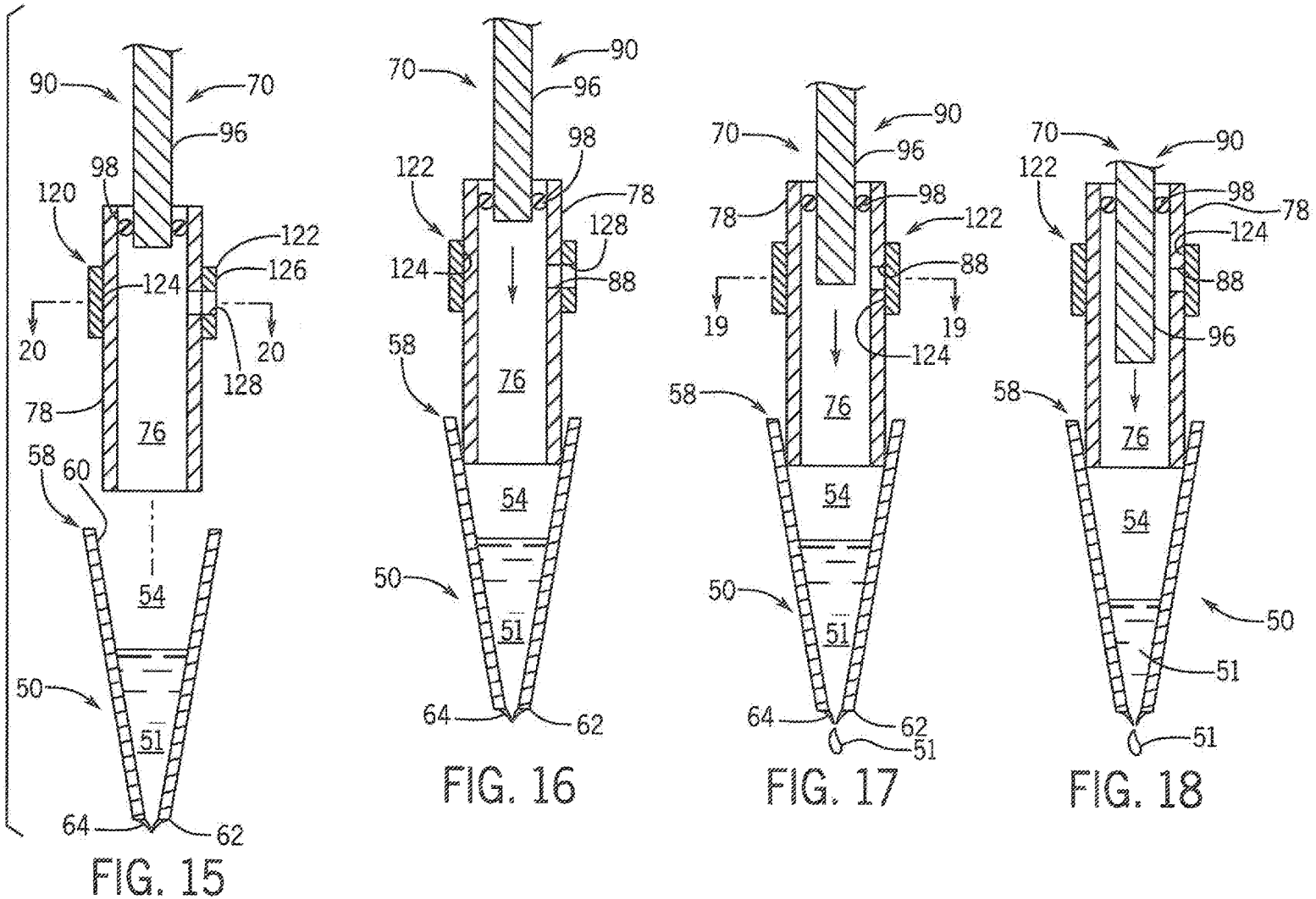
FIG. 15 is a schematic, cross-sectional view of the pipette of FIG. 6 including a second embodiment of a sealing arrangement and the pipette tip in a disassembled configuration.
FIG. 16 is a schematic, cross-sectional view of the pipette of FIG. 6 including the second embodiment of a sealing arrangement and the pipette tip in an assembled configuration with a plunger of the pipette in a first position.
FIG. 17 is a schematic, cross-sectional view of the pipette of FIG. 6 including the second embodiment of a sealing arrangement and the pipette tip in an assembled configuration with the plunger of the pipette in a second position.
FIG. 18 is a schematic, cross-sectional view of the pipette of FIG. 6 including the second embodiment of a sealing arrangement and the pipette tip in an assembled configuration with the plunger of the pipette in a third position.
Figure 19:
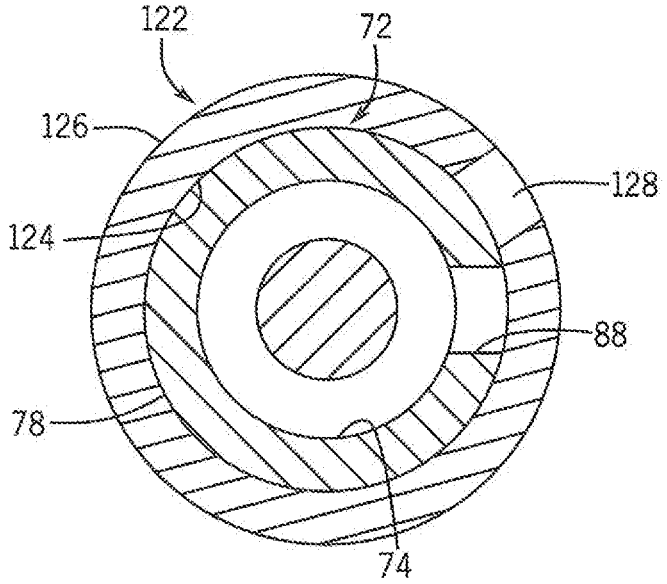
FIG. 19 is a schematic, cross-sectional view of the pipette of the present invention take along line 19-19 of FIG. 17.
Figure 20:
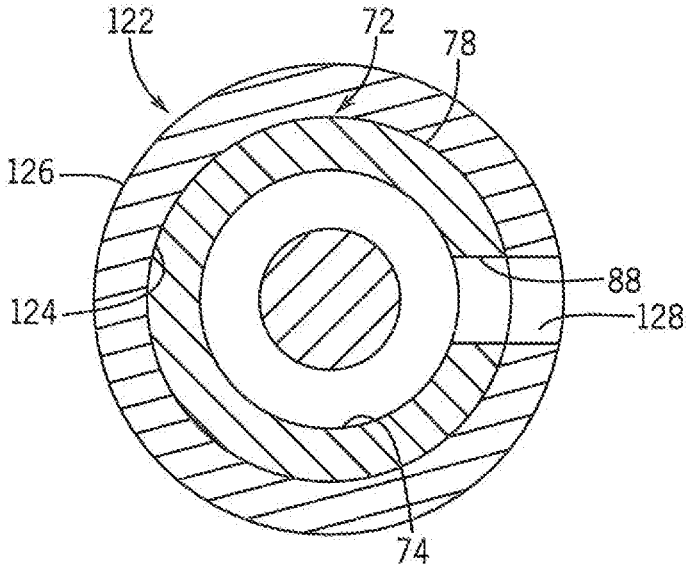
FIG. 20 is a schematic, cross-sectional view of the pipette of the present invention take along line 20-20 of FIG. 15.
Figure 22:
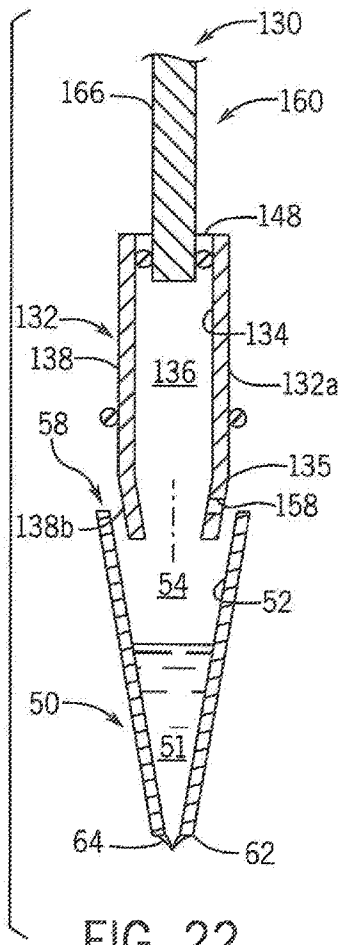
FIG. 22 is a schematic, cross-sectional view of the pipette of FIG. 21 and the pipette tip during assembly.

In operation, with elongated stem 90 of pipette 70 in the first position and prior to connecting pipette 70 to pipette tip 50, a user may selectively rotate collar 122 to the open position, FIG. 15, wherein passageway 76 through barrel 72 communicates with the environment outside of pipette 70 through opening 88 in barrel 72. Thereafter, second end 84 of barrel 72 is inserted into opening 60 in first end 58 of pipette tip 50 such that outer surface 78 of barrel 72 engages inner surface 52 of pipette tip 50, thereby frictionally retaining pipette tip 50 on pipette 70, FIG. 16. It can be appreciated that pipette 70 may be interconnected to pipette tip 50 in other manners without deviating from the scope of the present invention. With collar 122 in the open position, air in passageway 76 is allowed to exit passageway 76 through opening 88 in barrel 72 and pass into the environment outside of pipette 70, as pipette 70 is interconnected to pipette tip 50. As such, opening 88 in barrel 72 allows for pipette tip 50 to be installed on and connected to pipette 70 without causing selected fluid 51 to be ejected from pipette tip 50. Once pipette 70 is interconnected to pipette tip 50, collar 122 is rotated from the open position, FIG. 20, to the sealing position, FIG. 19, so as to isolate passageway 76 through barrel 72 from the environment outside of pipette 70, thereby maintaining the environment in passageway 76 through barrel 72 within the pipette 70 and pipette tip 50 combination. In order to urge selected fluid 51 from the pipette tip 50, elongated stem 90 of pipette 70 is axially inserted into first end 80 of barrel 72 such that the air captured in passageway 76 of barrel 72 urges selected fluid 51 from pipette tip 50 through opening 64 in second end 62 of pipette tip 50, FIGS. 17-18.

Referring to FIGS. 21-25, an alternate embodiment of a non-displasive pipette in accordance with the present invention is generally designated by the reference numeral 130. Pipette 130 includes a generally hollow barrel 132 having an inner surface 134 defining passageway 136 therethrough and an outer surface 138. Barrel 132 includes a first end 140 terminating at opening 142 and a second end 144 terminating at opening 146. In the depicted embodiment, barrel 132 includes a generally cylindrical portion 132*a* extending from first end 140 of barrel 132 and a generally conical portion 132*b* intersecting cylindrical portion 132*a* of barrel 132 at intersection 135 and converging to second end 144 of barrel 132. Openings 142 and 146 in first and second ends 140 and 144, respectively, are generally circular wherein the diameter of opening 146 in second end is less than the diameter of opening 142 in first end 140. It is contemplated for a generally circular seal, e.g. o-ring 148, having an outer surface 150 to be affixed to and forms an airtight seal with inner surface 134 of barrel 132 at a location adjacent first end 140 of barrel 132, for reasons hereinafter described. Inwardly directed portion 152 of outer surface 150 of o-ring 148 defines a passage 154 having a diameter. In addition, a generally circular gasket 151 extends about outer surface 138 of cylindrical portion 132*a* of barrel 132 at a location spaced from intersection 135. Gasket 151 has an inner surface 153 affixed to outer surface 138 of barrel 132 and a diameter generally equal to the diameter of first end 58 of pipette tip 50, for reasons hereinafter described. It is further contemplated for conical portion 132*b* of barrel 132 to include air passage 158 extending between the inner and outer surfaces 134 and 138, respectively, at a location adjacent second end 144 of barrel 132, for reasons hereinafter described.

Pipette 130 further includes plunger 159 partially received in passageway 136 through barrel 132. Plunger 159 includes an elongated stem 160 having first and second opposite ends (not shown) and 164, respectively, and a generally cylindrical outer surface 166. Elongated stem 160 has a diameter generally equal to the diameter of passage 154 though o-ring 148. An enlarged head (not shown) may be affixed to or integral with the first end of elongated stem 160 to facilitate the insertion of second end 164 of elongated stem 160 into passageway 136 of barrel 132.

Figure 21:
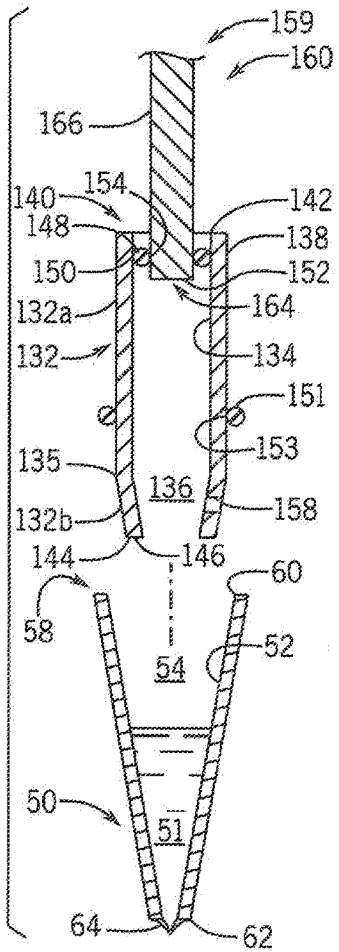
FIG. 21 is a schematic, cross-sectional view of a still further embodiment of a pipette in accordance with the present invention and the pipette tip in a disassembled configuration.
Figures 23, 24, 25:
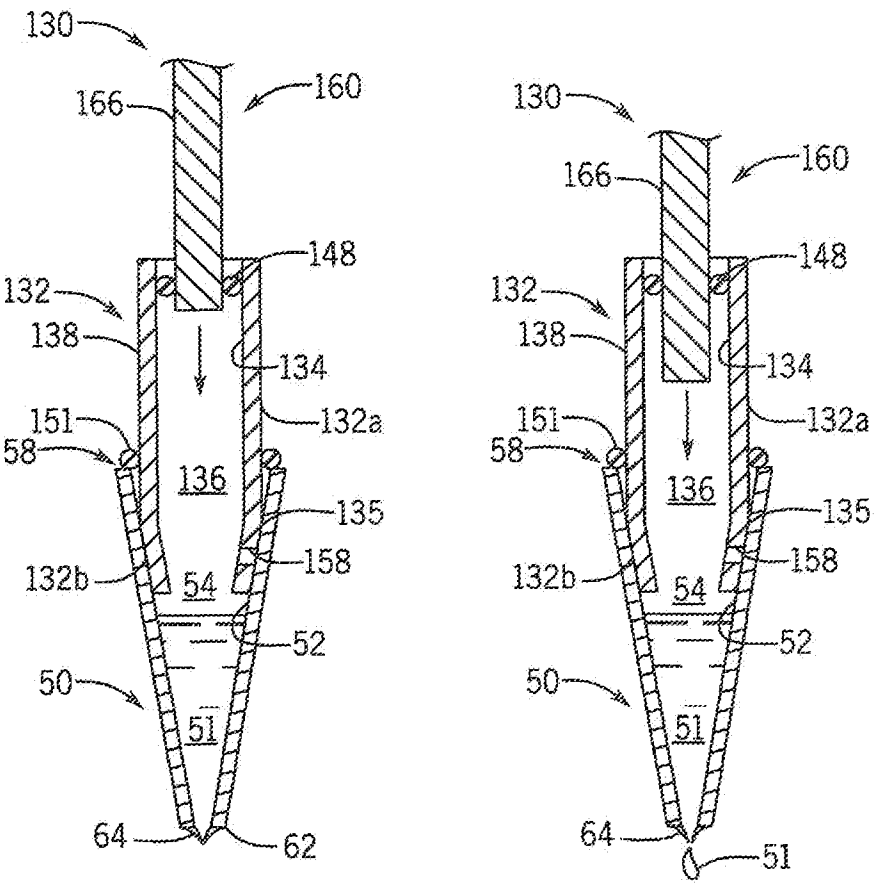
FIG. 23 is a schematic, cross-sectional view of the pipette of FIG. 21 and the pipette tip in an assembled configuration with a plunger of the pipette in a first position.
FIG. 24 is a schematic, cross-sectional view of the pipette of FIG. 21 and the pipette tip in an assembled configuration with the plunger of the pipette in a second position.
FIG. 25 is a schematic, cross-sectional view of the pipette of FIG. 21 and the pipette tip in an assembled configuration with the plunger of the pipette in a third position.

In operation, elongated stem 160 of pipette 130 is inserted into opening 142 in first end 140 of barrel 132 to a first extended position wherein outer surface 166 of elongated stem 160 is positioned within passage 154 though o-ring 148 and forms a slidable interface with engages inwardly directed portion 152 of o-ring 148, FIG. 21. With elongated stem 160 of pipette 130 in the first position, second end 144 of barrel 132 is inserted into opening 60 in first end 58 of pipette tip 50 until intersection 135 intersects inner surface 52 of pipette tip 50, thereby frictionally retaining pipette tip 50 on pipette 130, FIG. 22. As second end 144 of barrel 132 is inserted into opening 60 in first end 58 of pipette tip 50 and prior to intersection 135 of barrel 132 intersecting inner surface 52 of pipette tip 50, it can be appreciated that outer surface 138 of barrel 132 is spaced from inner surface 52 of pipette tip 50. As such, air in passageway 136 is allowed to exit pipette 130 through air passage 158 extending between the inner and outer surfaces 134 and 138, respectively, of conical portion 132*b* of barrel 132 and through a flow path defined between outer surface 138 of barrel 132 and inner surface 52 of pipette tip 50 such that the air passes into the environment outside of pipette 130 as pipette tip 50 as pipette 130 is interconnected to pipette tip 50, FIG. 23. As such, air passage 158 in conical portion 132*b* of barrel 132 allows for pipette tip 50 to be installed on and connected to pipette 130 without causing selected fluid 51 to be ejected from pipette tip 50. Once pipette 130 is interconnected to pipette tip 50, gasket 151 engages first end 58 of pipette tip 50 so as to isolate portion 136*a* of passageway 136 through barrel 132 from the environment outside of pipette 130, thereby maintaining the environment in passageway 136 through barrel 132 within the pipette 130 and pipette tip 50 combination, FIG. 22. Hence, air passage 158 in conical portion 132*b* of barrel 132 allows for pipette tip 50 to be installed on and connected to pipette 130 without causing selected fluid 51 to be ejected from pipette tip 50.

Once pipette 130 and pipette tip 50 are interconnected as heretofore described, the pipette 130 and pipette tip 50 combination may be transported to a desired location wherein selected fluid 51 may be urged from the pipette tip 50. More specifically, once pipette 130 and pipette tip 50 combination are transported to the desired location, elongated stem 160 of pipette 130 may be axially inserted into first end 140 of barrel 132 such the air captured in passageway 136 of barrel 132 urges the selected fluid 51 from pipette tip 50 through opening 64 in second end 62 of pipette tip 50, FIGS. 24-25.

Referring to FIGS. 26-29, a still further alternate embodiment of a non-displasive pipette in accordance with the present invention is generally designated by the reference numeral 170. Pipette 170 includes a generally hollow barrel 172 having an inner surface 174 defining passageway 176 therethrough and an outer surface 178. Barrel 172 includes a generally cylindrical upper portion 172*a* extending from first end 180 of barrel 172 and a generally cylindrical intermediate portion 172*b* interconnected to upper portion 172*a* by shoulder 179 formed in outer surface 178 of barrel 172. Shoulder 179 includes a generally planar ledge 181 generally perpendicular to and extending between upper and intermediate portions 172*a* and 172*b*, respectively, of barrel 172. As described, upper portion 172*a* of barrel 172 has a greater diameter than intermediate portion 172*b* of barrel 172, for reasons hereinafter described. Barrel 172 further includes a generally conical portion 172*c* intersecting intermediate portion 172*b* of barrel 172 at intersection 175 and converging to second end 184 of barrel 172. First end 180 of barrel 172 terminates at opening 182 and second end 184 of barrel 172 terminates at opening 186. Openings 182 and 186 in first and second ends 180 and 184, respectively, are generally circular wherein the diameter of opening 186 in second end 184 is less than the diameter of opening 182 in first end 180.

Pipette 170 further includes housing 190 extending about the outer periphery of barrel 172. Housing 190 includes a generally cylindrical upper wall 192*a* extending from first end 194 of housing 190 and a generally cylindrical lower wall 192*b* interconnected to upper portion 192*a* and terminating at second end 197 of housing 190. Upper wall 192*a* and lower wall 192*b* are interconnected by shoulder 196 formed in outer surface 198 of housing 190. Shoulder 196 includes a generally planar ledge 200 generally perpendicular to and extending between upper and lower walls 192*a* and 192*b*, respectively, of housing 192. As described, the cylindrical area defined by upper wall 192*a* of housing 192 has a greater diameter than the cylindrical area defined by lower wall 192*b* of housing 190, for reasons hereinafter described.

Figure 26A:
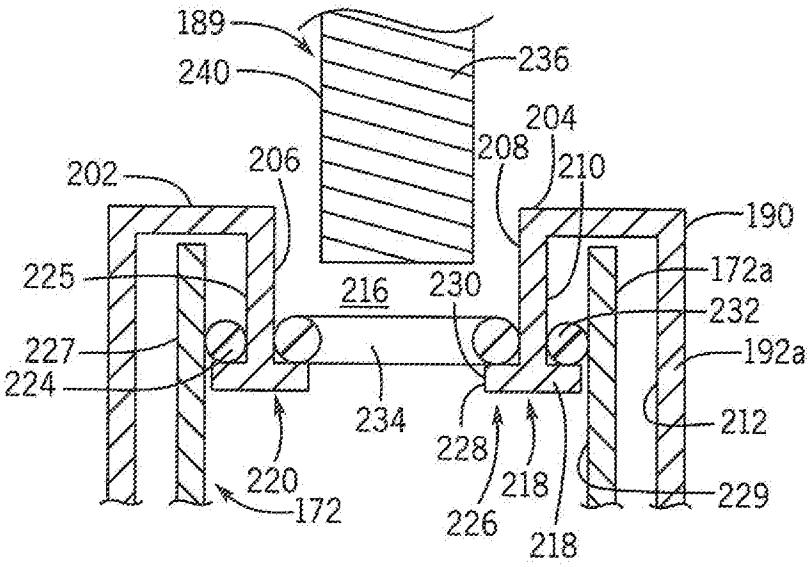
FIG. 26*a* is an enlarged schematic view showing a portion of the pipette of FIG. 26.
Figure 26:
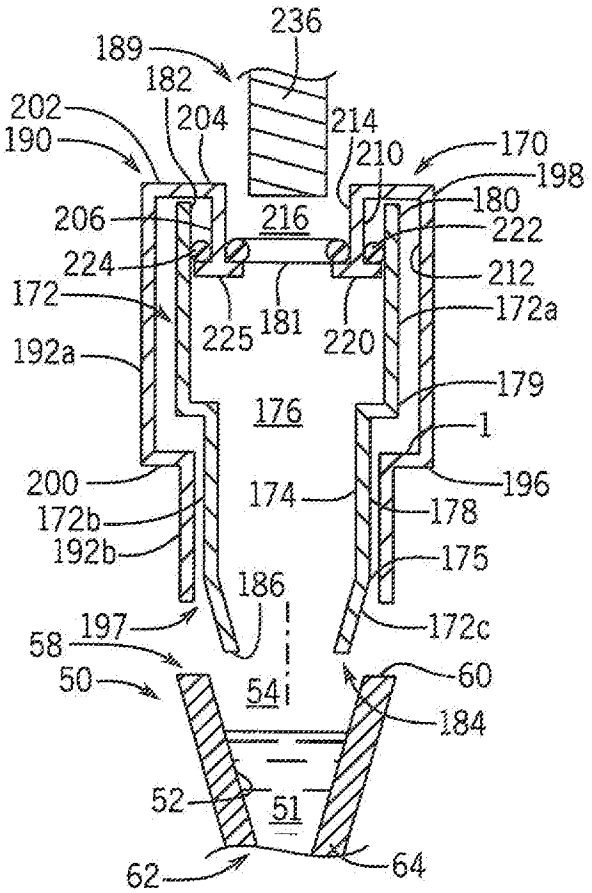
FIG. 26 is a schematic, cross-sectional view of a further alternate embodiment of a pipette in accordance with the present invention and the pipette tip in a disassembled configuration.

Housing 190 further includes a generally planar top wall 202 extending radially inward from upper wall 192*a* at first end 194 thereof. Top wall 202 terminates at a radially inner edge 204. As best seen in FIG. 26*a*, inner wall 206 depends from inner edge 204 of top wall 202 and terminates at a lower, terminal end 208. Inner wall 206 has a generally cylindrical configuration and includes an outer surface 210 directed at inner surface 212 of upper wall 192*a* and an inner surface 214 defining a passageway 216 for accommodating plunger 189 therethrough, as hereinafter described.

Gasket support wall 218 is interconnected to terminal end 208 of inner wall 206 of housing 190. Gasket support wall 218 includes a first portion 220 extending radially outward towards inner surface 212 of upper wall 192*a* and having a generally flat upper surface 222 adapted for receiving gasket 224 thereon. It is intended for gasket 224 to have an inwardly directed portion 225 in engagement with and forming an airtight seal with outer surface 210 of inner wall 206 of housing 190 and an outwardly directed portion 227 in slidable engagement with and forming an airtight seal with inner surface 229 of upper wall 172*a* of barrel 172. Gasket support wall 218 further includes a second portion 226 extending radially inwards from terminal end 208 of inner wall 206 and terminating at a radially inner edge 228 defining an opening 230 adapted for receiving plunger 189 therethrough. Second portion 226 of gasket support wall 218 includes a generally flat upper surface 232 adapted for receiving gasket 234 thereon.

Plunger 189 includes an elongated stem 236 having first and second opposite ends (not shown) and 238, respectively, and a generally cylindrical outer surface 240. An enlarged head (not shown) may be affixed to or be integral with a first end of elongated stem 236 to facilitate the insertion of second end 238 of elongated stem 236 through passageway 216 and opening 230 in housing 190 and into passageway 176 of barrel 172. It is contemplated for a generally circular seal, e.g. gasket 234, to have an inwardly directed portion 244 in engagement with and forming an airtight seal with outer surface 240 of elongated stem 236 of plunger 189. Outwardly directed portion 246 of outer gasket 234 is engageable with inner surface 214 of inner wall 206 of housing 190.

Figure 29:
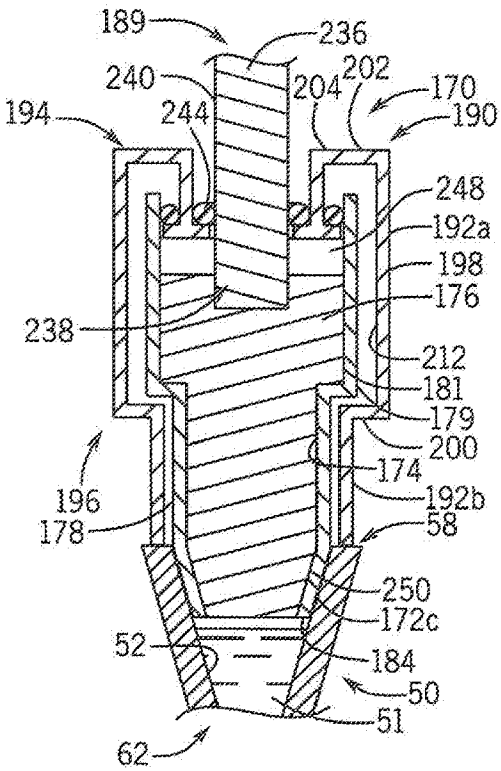
FIG. 29 is a schematic, cross-sectional view of the pipette of FIG. 26 and the pipette tip in an assembled configuration with the plunger of the pipette in a third position.
Figure 28:
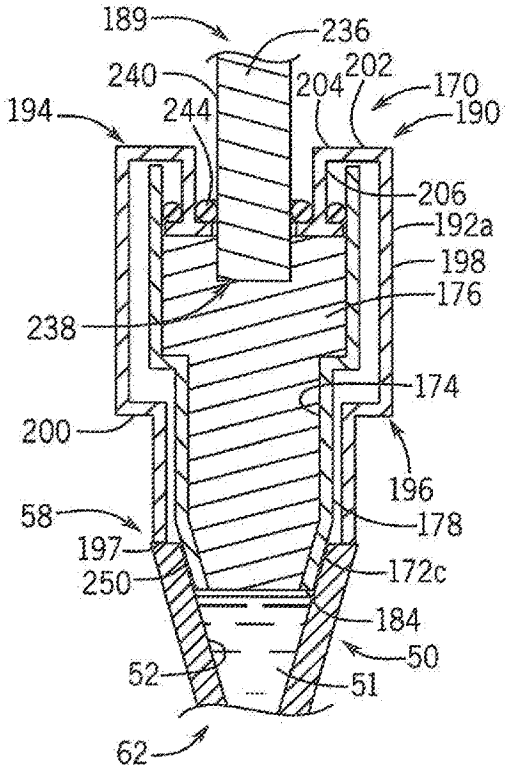
FIG. 28 is a schematic, cross-sectional view of the pipette of FIG. 26 and the pipette tip in an assembled configuration with the plunger of the pipette in a second position.
Figure 27:
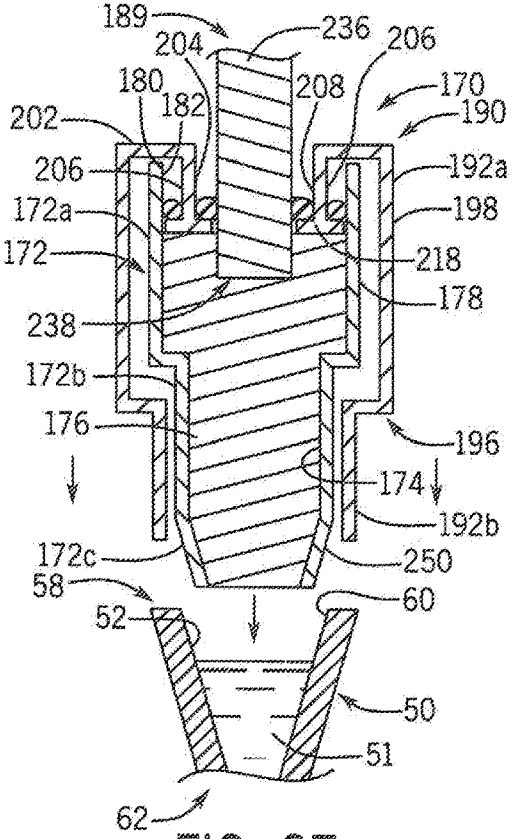
FIG. 27 is a schematic, cross-sectional view of the pipette of FIG. 26 and the pipette tip in an assembled configuration with a plunger of the pipette in a first position.

In operation, elongated stem 236 of pipette 170 is inserted through passageway 216 and opening 230 in housing 190 to a first extended position wherein second end 238 of elongated stem 236 is received in passageway 176 of barrel 172, FIG. 27. With elongated stem 236 of pipette 170 in the first position, second end 184 of barrel 172 is inserted into opening 60 in first end 58 of pipette tip 50 until second end 197 of housing 190 engages first end 58 of pipette tip 50, FIG. 28. Once second end 197 of housing 190 engages first end 58 of pipette tip 50, barrel 172 is slid axially downward in FIGS. 26-29 within housing 190 from a first elevated position to a second engaged position wherein shoulder 179 of barrel 172 engages shoulder 196 in housing 190 and outer surface 250 of conical portion 172*c* of barrel 172 engages and forms a sealing interface with inner surface 52 of pipette tip 50. As best seen in FIG. 29, the volume of passageway 176 increases (generally designated by the reference numeral 248 in FIG. 29) as barrel 172 moves from the elevated to the engaged position thereby allowing passageway 176 in barrel 172 to accommodate the additional volume of air received in passageway 176 from pipette tip 50 as pipette 170 is interconnected to pipette tip 50. As a result, pipette 170 may be installed on and connected to pipette tip 50 without causing selected fluid 51 to be ejected from pipette tip 50.

Once pipette 170 is interconnected to pipette tip 50, the pipette 170 and pipette tip 50 combination may be transported to a desired location wherein selected fluid 51 may be urged from the pipette tip 50. More specifically, once pipette 170 and pipette tip 50 combination are transported to the desired location, elongated stem 236 of pipette 170 may be axially inserted into passageway 176 such the air captured in passageway 176 of barrel 172 urges the selected fluid 51 from pipette tip 50 through opening 64 in second end 62 of pipette tip 50.

Various modes of carrying out the invention are contemplated as being within the scope of the following claims particularly pointing out and distinctly claiming the subject matter, which is regarded as the invention.

We claim:

1. A non-displasive pipette, the non-displasive pipette comprising:

a tip configured to receive a fluid therein, the tip extending along an axis and including an opening in a first end thereof, an orifice in a second end thereof to allow for the discharge of the fluid therefrom, and an inner surface defining a passageway therebetween for receiving the fluid, a body including an inner surface defining a chamber therethrough and having first and second opposite ends, the second end of the body insertable into the passageway through the opening in the first end of the tip to a fully inserted position;

a plunger having an outer surface and being slidably received in the first end of the chamber of the body, the plunger moveable in the chamber between a first extended position and a second depressed position;

a seal having an outer surface with a first portion engaged with and forming airtight seal with the inner surface of the body and a second portion engaged with and forming an airtight seal with the outer surface of the plunger; and an air escape passage extending through the body;

wherein:

the air escape passage configured to allow air from the chamber to escape therefrom in response to insertion of the second end of the body into the passageway of the tip through the opening in the first end of the tip such that, when fluid is received in the passageway of the tip, the fluid in the passageway of the tip remains therein during insertion of the second end of the body into the passageway of the tip.

2. The non-displasive pipette of claim 1 further comprising:

a sealing mechanism configured to selectively seal the air escape passage and prevent air from escaping the chamber with the second end of the body in the fully inserted position;

wherein:

the chamber communicates with an environment outside of the pipette through the air escape passage with the sealing mechanism in a first non-sealing position;

when fluid is received in the passageway of the tip, the fluid in the tip remains therein in response to movement of the plunger from the extended position to the depressed position;

the plunger is movable between the second depressed position and a third discharge position; and when fluid is received in the passageway of the tip, the fluid in the tip is urged from the tip through the orifice in response to movement of the plunger from the depressed position to the discharge position.

3. The non-displasive pipette of claim 1 further comprising:

a sealing mechanism configured to selectively seal the air escape passage and prevent air from escaping the chamber with the second end of the body in the fully inserted position;

wherein the sealing mechanism includes an air seal positioned along an outer surface of the body, the air seal movable between a first closed position wherein the air seal overlaps an intersection of the air escape passage and an outer surface of the body and prevents a flow of air through the air escape passage and a second open position wherein the air escape passage is allowed to communicate with the environment outside of the pipette.

4. The non-displasive pipette of claim 3 further comprising a biasing structure for urging the air seal towards the closed position.

5. The non-displasive pipette of claim 3 wherein:

the air seal includes a collar extending about the outer surface of the body; and rotation of the collar moves the air seal between the first closed position and the second open position.

6. A non-displasive pipette configured for connection to a tip having a fluid prepackaged therein, the tip including an opening in a first end thereof, an orifice in a second end thereof to allow for the discharge of the fluid therefrom, and a passageway therebetween for receiving the fluid, the non-displasive pipette comprising:

a body having an inner surface defining a chamber therethrough and having first and second opposite ends, the second end of the body insertable into the passageway through the opening in the first end of the tip to a fully inserted position;

a plunger having an outer surface and being slidably received in the first end of the chamber of the body, the plunger moveable in the chamber between a first extended position and a second depressed position;

an air escape passage extending through the plunger, the air escape passage configured to allow air from the chamber to escape therefrom in response to insertion of the second end of the body into the passageway of the tip; and a seal for selectively sealing the air escape passage and preventing air from escaping the chamber with the second end of the body in the fully inserted position, a seal extending about the plunger and forming a sealing interface with the body;

wherein:

the plunger includes a first end, a second end receivable in the chamber of the body and an outer surface;

the air escape passage extends through the plunger and intersects the outer surface of the plunger at a first location; and the seal extends about the outer surface of the plunger between the first location and the first end of the plunger with the plunger in the second depressed position.

7. A non-displasive pipette, comprising:

a tip configured for receiving a fluid therein, the tip extending along an axis and including an opening in a first end thereof, an orifice in a second end thereof to allow for the discharge of the fluid therefrom, and a passageway therebetween for receiving the fluid;

a body having an inner surface defining a chamber therethrough and having first and second opposite ends, the second end of the body insertable into the passageway in the tip through the opening in the first end of the tip to a fully inserted position;

a plunger having an outer surface and being slidably received in the chamber at the first end of the body, the plunger moveable with the chamber between an extended position and a discharge position wherein the fluid is urged from tip through the orifice; and an air discharge arrangement configured to allow air from the chamber to escape therefrom and to maintain the fluid in the tip in response to insertion of the second end of the body into the passageway of the tip;

a seal having an outer surface with a first portion engaged with and forming an airtight seal with the inner surface of the body at a location adjacent the first end of the body and a second portion engaged with and forming an airtight seal with the outer surface of the plunger; and a sealing mechanism movable between a first position wherein air is allowed to escape from the chamber and a second position wherein the sealing mechanism is configured to seal the air escape passage and prevent air from escaping the chamber with the second end of the body in the fully inserted position;

wherein fluid in the passageway of the tip remains therein during insertion of the second end of the body into the passageway of the tip.

8. The non-displasive pipette of claim 7, wherein:

the plunger is movable to a depressed position at a location between the extended position and the discharge position; and the fluid in the tip is maintained therein in response to movement of the plunger from the extended position to the depressed position and the sealing mechanism in the first position.

9. The non-displasive pipette of claim 7 wherein the air discharge arrangement includes an air escape passage extending through the body.

10. The non-displasive pipette of claim 9 wherein the sealing mechanism includes an air seal positioned along an outer surface of the body, the air seal movable between a first closed position wherein the air seal prevents air from the exiting the chamber and a second open position wherein the air seal allows to air exit the chamber.

11. The non-displasive pipette of claim 10 further comprising a biasing structure for urging the air seal towards the closed position.

12. The non-displasive pipette of claim 10 wherein:

the air seal includes a collar extending about an outer surface of the body; and rotation of the collar moves the air seal between the first closed position and the second open position.

* * * * *